United States Patent [19]

Mastboom

[11] Patent Number: 4,705,984

[45] Date of Patent: Nov. 10, 1987

[54] ELECTRICAL LAMP WITH A SCREW BASE FORMED BY IDENTICAL HALVES

[75] Inventor: Johannes G. P. Mastboom, Eindhoven, Netherlands

[73] Assignee: U.S. Philips Corporation, New York, N.Y.

[21] Appl. No.: 902,004

[22] Filed: Aug. 28, 1986

Related U.S. Application Data

[63] Continuation of Ser. No. 675,482, Nov. 28, 1984, abandoned.

[30] Foreign Application Priority Data

Dec. 1, 1983 [NL] Netherlands ..... 8304139

[51] Int. Cl.[4] ..... H01J 5/48; H01J 5/50

[52] U.S. Cl. ..... 313/318; 313/315; 445/22; 439/615

[58] Field of Search ..... 445/27, 22; 29/463; 313/318, 315; 339/144 R, 144 T, 145 R, 145 D, 145 T, 146

[56] References Cited

U.S. PATENT DOCUMENTS

| | | | |
|---|---|---|---|
| 3,875,628 | 4/1975 | Evans | 445/27 |
| 4,028,577 | 7/1977 | Gates et al. | 313/318 |
| 4,157,486 | 6/1979 | Fegley | 445/27 |
| 4,365,396 | 12/1982 | Baba et al. | 445/22 |
| 4,383,200 | 5/1983 | Van Zon et al. | 313/634 |
| 4,496,874 | 1/1985 | Sanders et al. | 313/318 |

*Primary Examiner*—David K. Moore
*Assistant Examiner*—Michael Razavi
*Attorney, Agent, or Firm*—David R. Treacy

[57] ABSTRACT

An electric lamp has a lower bowl portion formed as two semicircular halves, over part of which an Edison lamp cap is screwed. The two bowl halves have identical helical rib portions, the cross-section of each rib portion having a height and length selected so that the lamp cap thread fits over them, engaging top edges of ribs on one bowl half and the lower edges of the ribs on the other bowl half.

9 Claims, 4 Drawing Figures

ELECTRICAL LAMP WITH A SCREW BASE FORMED BY IDENTICAL HALVES

This is a continuation of application Ser. No. 675,482, filed Nov. 28, 1984, now abandoned.

BACKGROUND OF THE INVENTION

The invention relates to an electrical lamp provided with a lamp envelope in which a light source is arranged, this lamp further comprising between the lamp envelope and an Edison lamp cap a cone-shaped lamp bowl. The bowl is composed of two halves and which is provided at its wide part with a collar enclosing the lower side of the lamp envelope, and at its narrow part with a neck-shaped portion. The outer wall of the neck portion is provided with a helically ascending rib for screwing the Edison lamp cap, after the two halves of the lamp bowl have been placed against each other. Such a lamp is known.

The known lamp is, for example, a compact low-pressure mercury vapour discharge lamp having a base at one end, as described in U.S. Pat. No. 4,383,200, in which there is arranged within the lamp envelope a fluorescent discharge tube which is sealed in a vacuum-tight manner and is curved so that the discharge path is comparatively long. Such a lamp serves as an alternative to an incandescent lamp for general illumination purposes. In this low-pressure discharge lamp are further arranged an electrical stabilization ballast and an auxiliary means for the ignition, such as a starter. These components are located, for example, within the lamp envelope or in the space limited by the lamp bowl, which preferably consists of a synthetic material.

The cone-shaped lamp bowl of the known lamp is longitudinally subdivided, and composed of two halves. This is favorable in the manufacture of the lamp because these parts readily grip around the lower side of the lamp envelope. Complicated plug-in and clamping connections between the lamp bowl and the lamp envelope are then avoided. Moreover, adhesives are superfluous. After the halves of the lamp bowl are arranged with the collar around the lower side of the envelope, an Edison lamp cap having a standardized defined pitch is screwed onto the neck of the cone-shaped lamp bowl composed of the two halves. At least by means of this Edison lamp cap, the envelope and the bowl halves are held together.

Due to the presence of a helically ascending rib with its defined pitch arranged along the whole outer circumference of the neck of the lamp bowl, the two bowl halves differ from each other. This is disadvantageous. In fact, there are not only required two differently shaped jigs for manufacturing the respective bowl halves, but special measures are also necessary during the manufacture of the lamps to prevent the two types of bowl halves from being mistaken one for the other.

SUMMARY OF THE INVENTION

The invention has for its object to provide an electrical lamp which obviates the aforementioned disadvantages of the known lamp.

According to the invention, for this purpose an electrical lamp of the kind mentioned in the opening paragraph is characterized in that the two halves of the lamp bowl are identical. The ascending rib has a height and a cross-section less than the interior thread of the lamp cap, and viewed from the first bowl half to the second, is interrupted over a certain distance near the seam between the two halves and then extends on the second bowl half so as to be axially offset with respect to the helix defined by the first bowl half, but with the same pitch. Thus the rib parts on one bowl half form interrupted lower portions of a helically ascending bowl thread, and the rib parts on the other bowl half form interrupted upper portions of the same screw thread.

In the lamp according to the invention, the two bowl halves are also identical at the area of the neck-shaped portion. During manufacture, only one molding jig is therefore sufficient. Moreover, mistakes over the identity of the lamp halves cannot be made during the process of assembling the lamp. The rib extends over both halves of the lamp bowl in a manner such that, when the Edison lamp cap is screwed on, the rib portions engage the continuous helical thread of the cap as though they are not displaced with respect to each other. Such a combination is formed by the part of the rib located on the first bowl half and the (slightly offset) part of the rib located on the second bowl half so that both rib parts are situated in circumferentially spaced portions of the same groove portion in the inner wall of the Edison lamp cap, The invention can be used for different types of lamps, such as an electrical incandescent lamp (in which as light source a filament is arranged in the lamp envelope) or a high-pressure discharge lamp. A very favorable application of the invention is a low-pressure mercury vapour discharge lamp having a base at one end, in which besides a fluorescent discharge tube sealed in a vacuum-tight manner there are also integrated a starter and a stabilization ballast, see U.S. Pat. No. 4,383,200, mentioned earlier. Such lamps are provided, for example, with a cylindrical glass envelope, whose lower side is enclosed by the collar of the lamp bowl.

The invention will be described more fully with reference to a drawing.

DESCRIPTION OF THE PREFERRED EMBODIMENT

Figure 1:
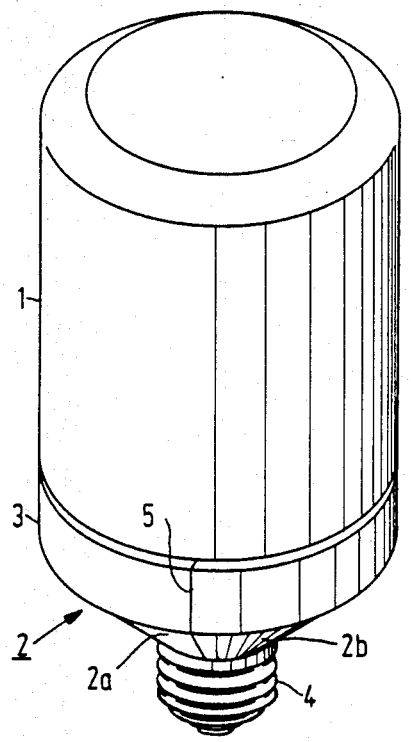
FIG. 1 is a perspective view of an embodiment of a low-pressure mercury vapour discharge lamp according to the invention.

The lamp shown in FIG. 1 comprises a glass lamp envelope 1. The outer wall of this envelope is provided with a ripple pattern, as a result of which a homogeneous brightness is obtained during operation of the lamp. This envelope accommodates a tubular discharge vessel which is sealed in a vacuum-tight manner and which is curved at a plurality of areas and has the form of a hook (not visible in the drawing). The inner wall of the discharge vessel is provided with a luminescent layer. The lamp is further provided with a thin-walled cone-shaped lamp bowl 2 consisting of synthetic material (for example polycarbonate) and longitudinally subdivided so as to be composed of two halves (*2a, 2b*). At the wide part of the lamp bowl there is provided a collar 3 which tightly encloses the outer wall of the lower side of the envelope 1. Moreover, adhesive is present between the collar 3 and the envelope for strengthening. Within the lamp bowl is disposed a part of the electrical stabilization ballast which extends as far as within the lamp envelope. The ballast is secured on a metal plate-shaped support on which are further arranged the discharge vessel, a starter and a few electronic components. This support is not visible in the drawing (cf., however, for example, U.S. Pat. No. 4,383,200). At the narrow part of the lamp bowl there is a neck-shaped part onto which an Edison lamp cap 4 is screwed. The two bowl halves 2*a* and 2*b* are then pressed against each other, a seam 5 then being formed. In one embodiment, an adhesive is also present between the bowl halves at the area of the seam.

Figure 2:
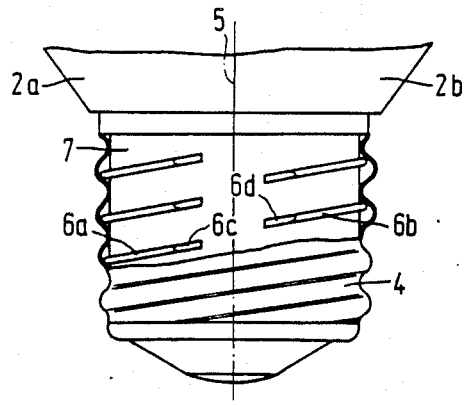
FIG. 2 is an elevation of an enlarged detail of the neck portion of the lamp bowl the lamp cap of the lamp shown in FIG. 1.

The two lamp bowl halves 2*a* and 2*b* are identical. The helically ascending rib (6*a*, 6*b*, see FIG. 2), which is present on the outer wall at the area of the neck 7, is interrupted, viewed from the lamp bowl half 2*a* to the lamp bowl half 2*b*, over a certain distance near the seam 5. The rib on the half 2*b* (designated by way of example by 6*b*) is offset with respect to the rib half 6*a* on the part 2*a* in axial direction when the two halves have been placed against each other. The extent to which the rib is offset is such that the rib part 6*a* partly urges against the lower side of the same groove portion in the Edison cap 4 and 6*b* partly urges against the upper side of the same groove portion. At the area of the transition between 2*a* and 2*b* (the seam 5) the rib is absent over a part of the circumference of about 20° on either side of the seam; thus each rib part extends over approximately 140° of the circumference. Over a circumferential part of about 10° at the extremities of the rib parts, the height of the rib moreover gradually decreases. This is designated by 6*c* and 6*d*. The rib parts 6*a*, 6*b* have a helically shaped path, corresponding to the groove in the Edison-cap, which has a standardized pitch (as used herein, "pitch" refers to the axial distance between the crest of one turn of thread and the crest of the next). As is shown clearly in FIG. 2, each rib part has a cross-section whose axial length is much less than half the helix pitch.

Figure 3:
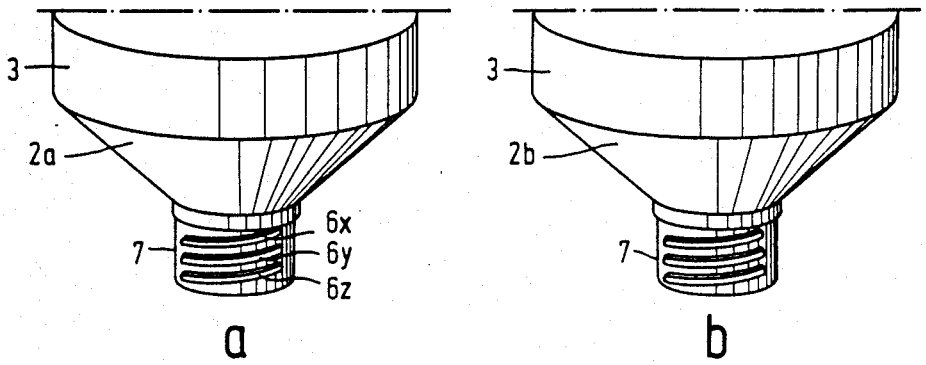
FIG. 3 shows an embodiment of the two identical lamp bowl halves before they are placed against each other.

As appears from FIG. 3 (*a*, *b*), the two bowl halves 2*a* and 2*b* are identical. At the area of the neck portion 7, a number of parallel arranged and ascending parts of the rib are present. These parts are designated for the half 2*a* by 6*x*, 6*y* and 6*z*.

In a practical embodiment of a lamp according to the invention, the lamp envelope 1 comprises on the lower side a recess which extends along its circumference and into which fits the collar 3 of the lamp bowl. The outer diameter of the envelope at the area of said recess amounts to 62 mm. The height of the said collar is 17 mm. The length of the neck portion 7 is 11 mm. The distance between the rib parts 6*x* and 6*y* and between 6*y* and 6*z*, respectively, is 4 mm (measured between the centre lines).

The outer diameter of the neck at the area of the seam amounts to 22 mm. At the area of the part at which the rib is present, the outer diameter (the height of the rib exclusive) is 24 mm. An E-27 (standard in the industry) can can then be screwed onto the lamp bowl without difficulty.

What is claimed is:

1. An electric lamp provided with a lamp envelope in which a light source is arranged, this lamp further comprising, between the lamp envelope and an Edison cap having a helically ascending thread, a cone-shaped lamp bowl which is composed of two halves and is provided at its wide part with a collar enclosing the lower side of the lamp envelope and at its narrow part with a neck-shaped portion the outer wall of which is provided with a helically ascending rib for screwing the Edison lamp cap, the two halves of the lamp bowl being placed against each other, characterized in that the two lamp bowl halves are identical, the ascending rib being interrupted, viewed from the first bowl half to the second, at the seam between the two halves and then extending on the second bowl half so as to be axially offset, but with the same pitch, whereby portions of said rib formed on one bowl half engage lower portions of said helically ascending thread, and portions of said rib on the other half engage upper portions of said helically ascending thread.

2. An electric lamp comprising a lamp envelope in which a light source is arranged, an Edison cap having a helically ascending cap thread and an inner wall defining an interior cap thread having a helically grooved portion with a given pitch, said grooved portion having a given groove cross-section, and a cone-shaped lamp bowl arranged between said cap and said envelope, said bowl being composed of two halves placed against each other; at its wide part said bowl having a collar enclosing the lower side of the lamp envelope; and at its narrow part said bowl having a neck-shaped portion with an outer wall and rib means for engaging said interior cap thread, characterized in that the two lamp bowl halves are identical, and said rib means comprises a plurality of helically ascending rib parts, said parts each having a pitch equal to said given pitch, and a rib part cross-section less than said given groove cross-section; said rib parts being so arranged that, upon assembly of two bowl halves to form a bowl, the rib parts of one half form interrupted lower portions of a helically ascending bowl thread, and the rib parts of the other half form interrupted upper portions of said helically ascending bowl thread, said helically ascending bowl thread engaging said helical groove in the cap, whereby said cap can be installed on the bowl by screwing the cap onto said rib means.

3. A lamp as claimed in claim 2, characterized in that each rib part extends over approximately 140° about said neck-shaped portion.

4. A lamp as claimed in claim 3, characterized in that at the extremities of the rib parts, the height of each rib part gradually decreases.

5. A lamp as claimed in claim 2, characterized in that at the extremities of the rib parts, the height of each rib part gradually decreases.

6. An electric lamp comprising a lamp envelope in which a light source is arranged, a cap having an inner wall defining an interior cap thread having a helically grooved portion with a given pitch, said grooved portion having a given groove cross-section, and a cone-shaped lamp bowl arranged between said cap and said envelope, said bowl being composed of two halves placed against each other; at its wide part said bowl having a collar enclosing the lower side of the lamp envelope; and at its narrow part said bowl having a neck-shaped portion with an outer wall and rib means for engaging said interior cap thread, characterized in that the two lamp bowl halves are identical, and said rib means comprises a plurality of helically ascending rib parts, said parts each having a pitch equal to said given pitch and a cross-section having an axial length substantially less than half said given pitch, and a height less than the height of said helical groove; said rib parts being so arranged that, upon assembly of two bowl halves to form a bowl, the rib parts of one half form interrupted lower portions of a helically ascending bowl thread, and the rib parts of the other half form interrupted upper portions of said helically ascending bowl thread, said helically ascending bowl thread engaging said helical groove in the cap, whereby said cap can be installed on the bowl by screwing the cap onto said rib means.

7. A lamp as claimed in claim 6, characterized in that each rib part extends over approximately 140° about said neck-shaped portion.

8. A lamp as claimed in claim 7, characterized in that at the extremities of the rib parts, the height of each rib part gradually decreases.

9. A lamp as claimed in claim 7, characterized in that at the extremities of the rib parts, the height of each rib part gradually decreases.

* * * * *